United States Patent [19]

Aschauer

[11] Patent Number: 4,573,861

[45] Date of Patent: Mar. 4, 1986

[54] APPARATUS FOR FEEDING SHEET METAL ELEMENTS TO A BENDING

[75] Inventor: Johann Aschauer, Eferding, Austria

[73] Assignee: Voest-Alpine Aktiengesellschaft, Linz, Austria

[21] Appl. No.: 503,793

[22] Filed: Jun. 13, 1983

[30] Foreign Application Priority Data

Jun. 23, 1982 [AT] Austria ..... 2420/82

[51] Int. Cl.[4] ..... B21D 43/11

[52] U.S. Cl. ..... 414/751; 414/225; 72/420; 72/422

[58] Field of Search ..... 414/34, 67, 222, 225, 414/749–751; 198/375, 412, 414, 486, 379; 72/419, 420, 422

[56] References Cited

U.S. PATENT DOCUMENTS

| | | | |
|---|---|---|---|
| 2,222,504 | 11/1940 | Essen | 198/379 X |
| 2,293,553 | 8/1942 | Magnusson | 198/379 X |
| 3,604,570 | 9/1971 | Canner | 414/749 X |
| 3,796,087 | 3/1974 | Liebergeld | 72/421 |
| 3,910,420 | 10/1975 | Rich | 414/749 X |
| 4,016,968 | 4/1977 | Stelter | 198/414 X |
| 4,133,423 | 1/1979 | Zankl | 414/749 X |
| 4,274,801 | 6/1981 | Herb et al. | 414/749 X |

FOREIGN PATENT DOCUMENTS 2839978 3/1979 Fed. Rep. of Germany .

*Primary Examiner*—Joseph E. Valenza
*Assistant Examiner*—David A. Bucci
*Attorney, Agent, or Firm*—Kurt Kelman

[57] ABSTRACT

An apparatus for feeding and rotating a sheet metal element comprises a frame and a carriage displaceably mounted on the frame for feeding the sheet metal element. The sheet metal element is selectively gripped in a predetermined plane by a non-rotatable gripping jaw mounted on the carriage, a rotary backing jaw rotatable about an axis extending perpendicularly to the plane, and a rotary gripping jaw carried by the frame independently of the carriage and rotatable about the axis, the non-rotatable gripping jaw and the rotary gripping jaw being adapted selectively to cooperate with the rotary backing jaw to grip the sheet metal element therebetween. The backing jaw is alternately and selectively forced against the non-rotatable or the rotary gripping jaw to grip the sheet metal element therebetween, and a rotary drive is mounted on the frame independently of the carriage and is operable to rotate the rotary gripping jaw when the sheet metal element is gripped between the rotary gripping and backing jaws.

12 Claims, 8 Drawing Figures

Figure 1:
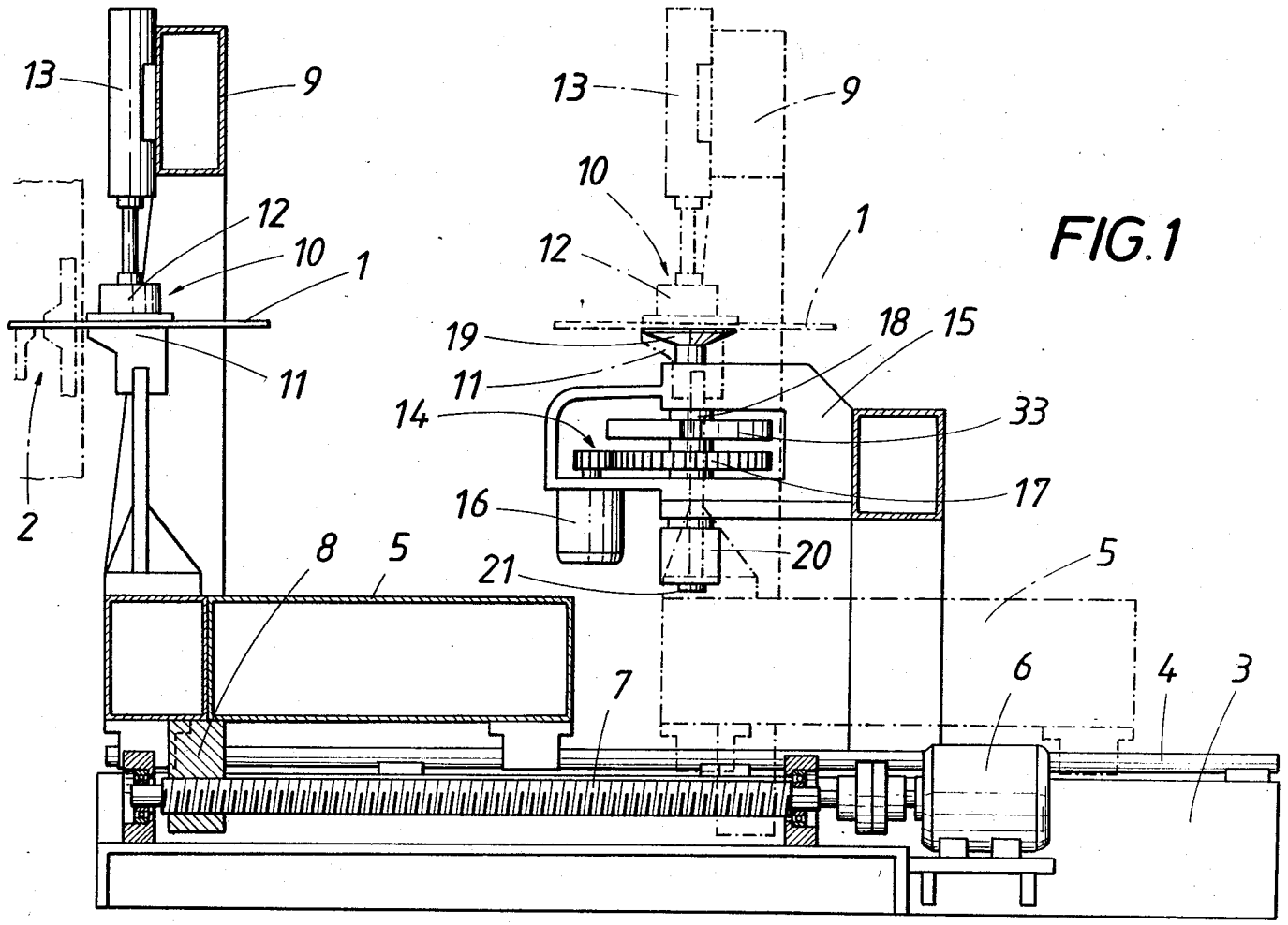

1
2
3
4
5
6
7
8
9
10
11
12
13
14
15
16
17
18
19
20
21
33

FIG. 3
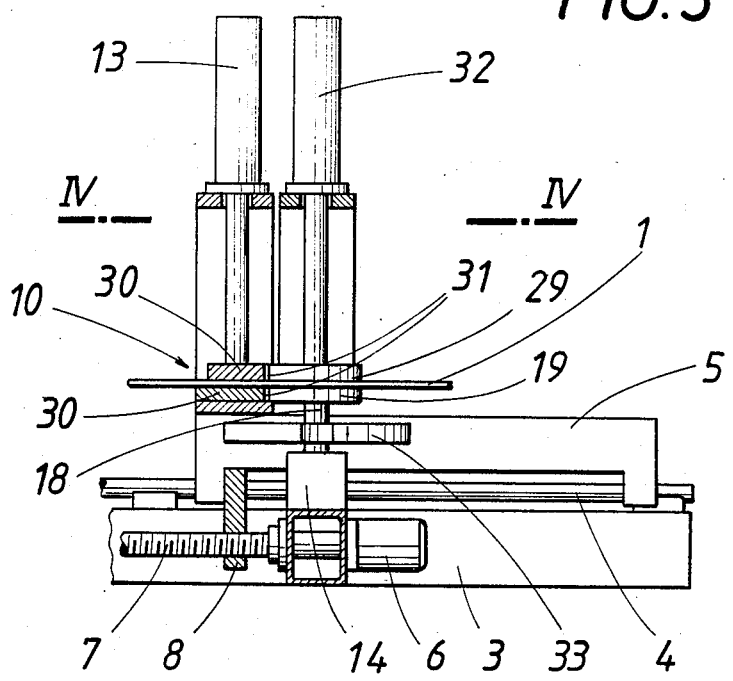
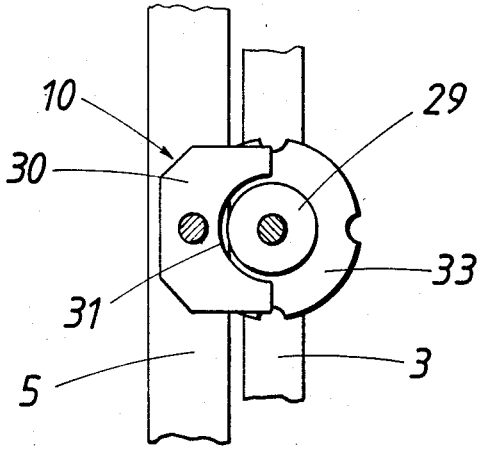
FIG. 4

APPARATUS FOR FEEDING SHEET METAL ELEMENTS TO A BENDING

This invention relates to apparatus for feeding sheet metal elements to a bending machine, in which apparatus a carriage is displaceably mounted on a frame and carries gripping means for gripping the sheet metal elements in a predetermined plane, a rotary backing jaw is rotatable about an axis that is at right angles to the predetermined plane, a rotary gripping jaw is adapted to cooperate with the rotary backing jaw so as to grip the sheet metal element this is rotatable about an axis, and rotary drive means is provided for rotating the rotary gripping jaw about its axis.

To permit a sheet metal element to be bent to different shapes at each of its four peripheral sides, it is necessary to advance the workpiece over different distances toward the bending machine and to rotate the sheet metal element about an axis which is normal to the plane of the sheet metal element so that the sheet metal element can be introduced into the bending machine with each side of the sheet metal element where the latter is to be bent. For this purpose it is known from Laid-open German Application No. 28 39 978 to grip the workpiece by gripping means mounted on a carriage, which is movably supported by a frame. The gripping jaws of the gripping means are mounted to be rotatable about a common axis so that the workpiece gripped between the gripping jaws can be rotated by the rotary drive means to any desired position. This apparatus has the disadvantage that the rotary drive means is carried by the carriage so that the weight of the latter is increased and, as a result, it is more difficult to accelerate the carriage so that the non-productive times are increased. If the rotary drive means is comparatively light in weight, the index disc, which is essential for a proper positioning of the workpiece, must be so small that the workpieces cannot be accurately handled. Besides, the rotary drive means, which is coaxial with the gripping jaws, requires space in the leading portion of the carriage, which interferes with a movement of the carriage as close as possible to the bending machine. Finally, the gripping forces exert a load on the rotary drive means so that the accuracy and speed with which the workpiece is handled is reduced. For these reasons, the known apparatus cannot be used for a fast and exact feeding of heavy workpieces to a bending machine.

It is an object of the invention to avoid these disadvantages and so to improve an apparatus which is of the kind described first hereinbefore and serves to feed sheet metal elements to a bending machine that the workpieces can be exactly positioned although the carriage is comparatively light in weight.

This object is accomplished according to the invention the combination of a frame, a carriage displaceably mounted on the frame for feeding the sheet metal element, and gripping means operable to grip the sheet metal element in a predetermined plane, the gripping means including a non-rotatable gripping jaw mounted on the carriage, a rotary backing jaw rotatable about an axis extending perpendicularly to the plane, and a rotary gripping jaw carried by the frame independently of the carriage and rotatable about the axis, the non-rotatable gripping jaw and the rotary gripping jaw being adapted selectively to cooperate with the rotary backing jaw to grip the sheet metal element therebetween. Actuating means is operable in alternation to force the backing jaw selectively against the non-rotatable or the rotary gripping jaw to grip the sheet metal element therebetween, and rotary drive means is mounted on the frame independently of the carriage and is operable to rotate the rotary gripping jaw when the sheet metal element is gripped between the rotary gripping and backing jaws.

In this arrangement, the carriage does not carry the rotary gripping jaw and the rotary drive means so that the carriage will be relatively light in weight even if the gripping means is heavy. As a result, the carriage can be highly accelerated by economically attractive means. The pivotal movement of the sheet metal elements to be bent is imparted to the sheet metal elements by rotary drive means mounted on the frame, and the rotary gripping and backing jaws need to grip the workpiece only with a force which will ensure that the workpiece will not slip as it is rotated by said jaws. For this reason, the gripping forces to be exerted on the workpiece during its rotation may be relatively small so that they will impose only a small load on the apparatus. To permit the rotary drive means to be mounted separately from the gripping means carried by the carriage, the gripping means must not obstruct the rotation of the workpiece and must be capable of transferring the workpiece in a proper orientation to the rotary gripping jaw. That requirement will be met in a simple manner if the gripping means carried by the carriage and the rotary gripping jaw carried by the frame are operated in alternation to grip the workpiece. The gripping means carried by the carriage does not release the workpiece until the latter has been gripped by the rotary gripping jaw carried by the frame in order to ensure that the workpiece will always be held in position by the gripping means or the rotary gripping and backing jaws at any time.

It is apparent that the provision of a separate rotary gripping jaw and of drive means for rotating the jaw will ensure a fast and exact handling of the sheet metal elements which are to be bent. As the rotary gripping jaw and the rotary drive means are not carried by the carriage, the latter can be more highly accelerated and can be moved very close to the bending machine. Because the rotary backing jaw and the rotary drive means are mounted in the frame independently of the carriage, there is almost no restriction regarding the design of the rotary drive means so that larger index discs may be provided, which are required for an exact handling of heavy workpieces. As there is no restriction regarding the weight of the rotary drive means and the load on the rotary drive means may be relatively small, the workpieces can be angularly adjusted at a higher speed.

To ensure that the workpiece will not be deflected when it is taken over by the gripping means carried by the carriage and by the rotary gripping and backing jaws, the gripping means carried by the carriage may comprise two gripping jaws, which are formed with recesses that are open toward the rotary gripping and backing jaws, respectively, and are arranged to receive the rotary jaws when the carriage has been retracted. In that arrangement, the gripping means carried by the carriage and the rotary jaws can grip closely spaced apart portions of the workpiece so that the latter will not shift as it is taken over by the gripping means or the rotary jaws. Besides, the fact that the rotary jaws can be received in recesses of the gripping jaws carried by the carriage permits a coaxial arrangement of these jaws so that the workpiece which has been rotated will not shift as it is taken over by the gripping means carried by the carriage.

In order to reduce the structural expenditure, one of the gripping jaws of the gripping means carried by the carriage may have a recess which is open toward the rotary gripping jaw and adapted to receive the rotary gripping jaw when the carriage has been retracted and may cooperate with an additional gripping jaw carried by the carriage, or the gripping means carried by the carriage may comprise a pair of gripping jaws which are adapted to cooperate with an additional gripping jaw and spaced apart and adapted to receive the rotary gripping jaw between them when the carriage has been retracted, and the additional gripping jaw may be mounted in the carriage for rotation on an axis which is at right angles to the plane in which the sheet metal elements are gripped. In that case, the elimination of a separate backing jaw for cooperation with the rotary gripping jaw will not restrict the movements which can be imparted to the workpiece. The workpiece will be exactly taken over because the gripping jaws carried by the carriage need not release the workpiece until the rotary gripping jaw forces the workpiece against the rotary backing jaw. In such an arrangement, the clamping forces which are exerted may result in distortions of the frame and of the carriage. To ensure that such distortions will not affect the guidance of the carriage, the rotary gripping jaw may be mounted in the frame to be displaceable in a direction which is at right angles to the plane in which the sheet metal element is gripped and may be connected to lifting drive means, which is movable relative to the frame in the direction and is supported by the carriage when the latter has been retracted. When the lifting drive means are actuated while the carriage has been retracted, the lifting drive means will engage the carriage until the rotary gripping jaw can be forced against the rotary backing jaw. The support of the lifting drive means on the carriage will ensure that the carriage will constitute a feedback path for the gripping forces so that the latter cannot act in a disturbing manner outside the carriage.

In a particularly desirable arrangement, the rotary backing jaw comprises a rotary disc mounted in a carrying member for a limited displacement in a direction which is parallel to the plane in which the sheet element is gripped, and the rotary disc has a centering bore, which is adapted to receive a spring-biased centering pin, which is slidably mounted in the carrying member and carries an actuating finger adapted to protrude from the centering disc on the side opposite to the carrying member and which is smaller in diameter than the centering bore. As the rotary disc can be displaced parallel to the plane in which the sheet metal element is gripped, any deformation adjacent to the carrying member which is caused by the action of the rotary gripping jaw cannot result in a shifting of the workpiece relative to the rotary jaws by which it is gripped during a rotation of the workpiece so that the position of the workpiece will not be changed during its rotation. The rotary disc is being centered as the workpiece is released by the rotary gripping jaw, which then releases also the actuating finger carried by the centering pin so that the latter is urged under its spring bias into the centering bore of the rotary disc and the actuating finger protrudes from the rotary disc on the side which is opposite to the carrying member. As the rotary gripping jaw is actuated to grip the workpiece, the centering pin is depressed against its spring bias out of the centering bore by means of the actuating finger, which extends in the centering bore. The difference between the diameters of the centering bore and the actuating finger ensures that the rotary disc is capable of a limited displacement.

If the rotary disc surrounds the carrying member, the rotary disc cannot be non-rotatably supported by the carrying member. If one of the jaws of the gripping means carried by the carriage serves also as a rotary backing jaw for cooperation with the rotary gripping jaw, it may be desirable for the gripping of the workpiece by the gripping means carried by the carriage to provide a non-rotatable gripping jaw adjacent to the rotary backing jaw which is constituted by the rotary disc. For this purpose, the carrying member may surround the rotary disc and may constitute a non-rotatable gripping jaw. In that case, the carrying member must be slightly set back from the gripping surface of the rotary disc so that the freedom of rotation of the workpiece engaging the rotary disc will be ensured. Owing to that setback, the gripping means carried by the carriage will deform the workpiece. The deformation must be in the elastic range and will ensure a particularly firm gripping of the workpiece.

Figure 2:
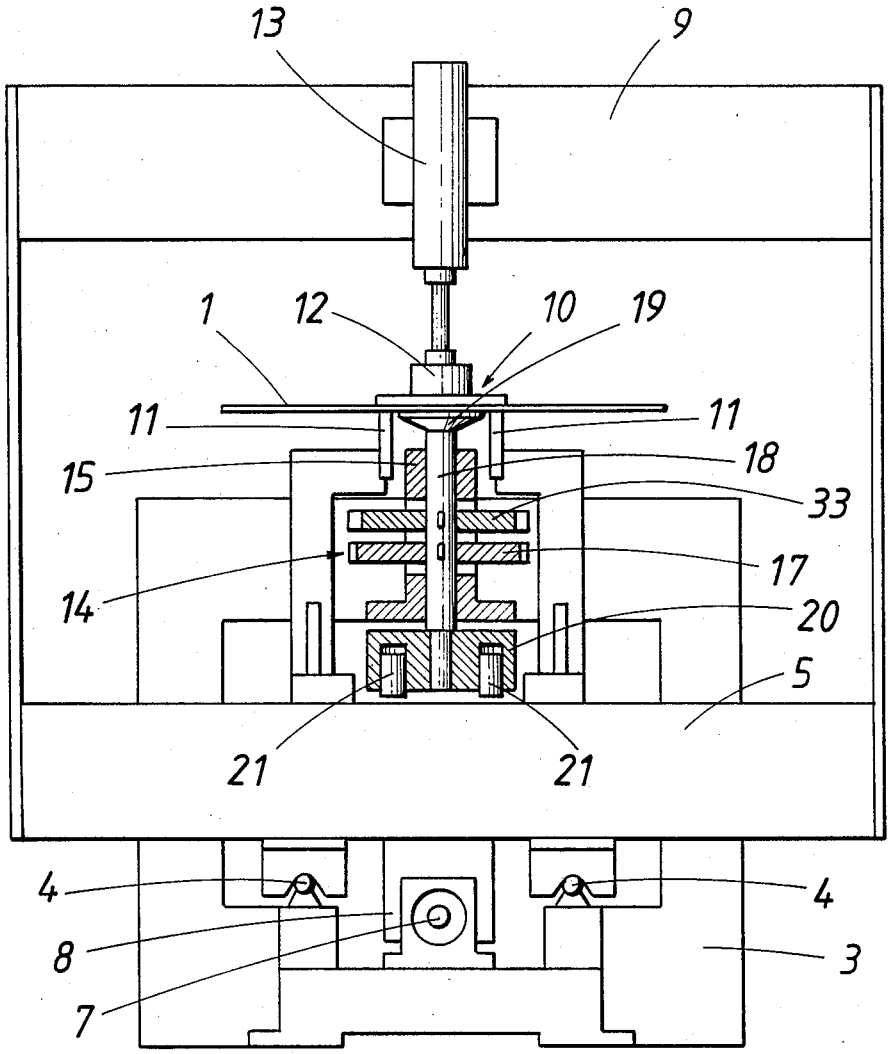
Figure 7:
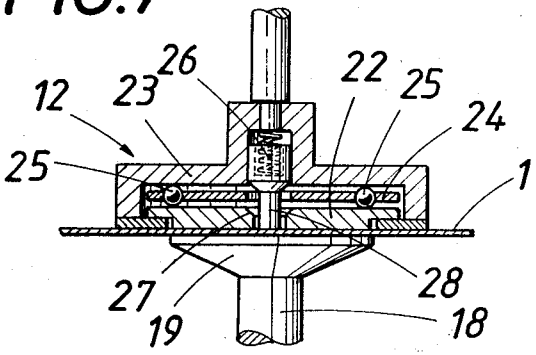
Figure 8:
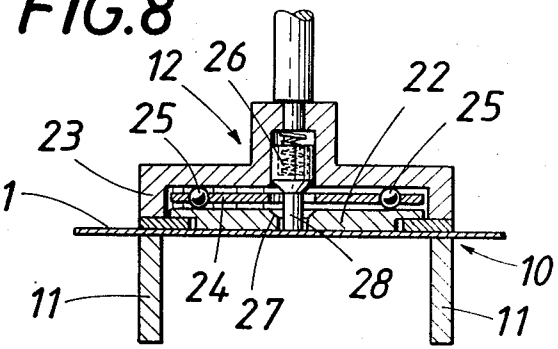
Figure 5:
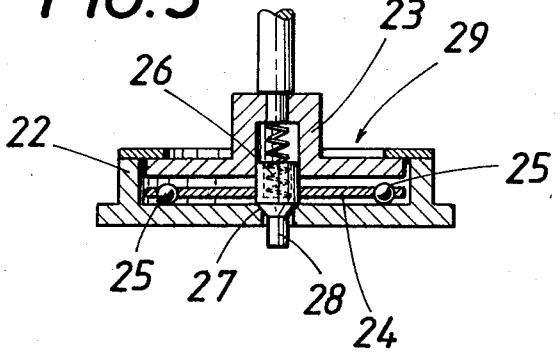
Figure 6:
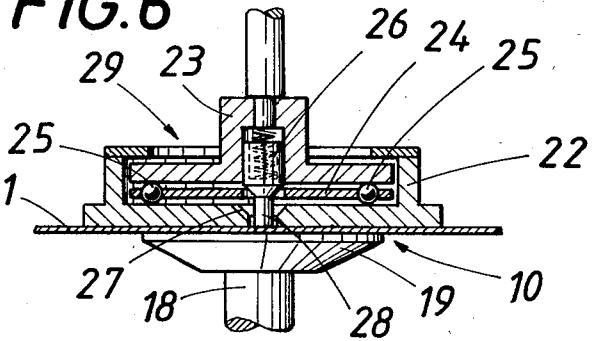

The subject matter of the invention is shown by way of example in the drawings, in which FIG. 1 is a simplified longitudinal sectional view showing apparatus embodying the invention and serving to feed sheet metal elements to a bending machine, FIG. 2 is an end elevation, partly in section, and shows the apparatus of FIG. 1, FIG. 3 is a simplified longitudinal sectional view showing a structural modification of the apparatus according to the invention, FIG. 4 is a sectional view taken on line IV—IV in FIG. 3, FIG. 5 is an axial sectional view showing a gripping jaw comprising a rotary disc, FIG. 6 shows the rotary disc of FIG. 5 in gripping engagement with a rotary gripping jaw, FIG. 7 shows a modified rotary backing jaw which is combined with a non-rotatable gripping jaw and cooperates with a rotary gripping jaw, and FIG. 8 shows the non-rotatable gripping jaw of FIG. 7 in gripping engagement with two gripping jaws carried by the carriage.

The apparatus shown in FIGS. 1 and 2 and serving to feed sheet metal elements 1 to a bending machine 2, which is indicated in phantom, comprises a frame 3 and a carriage 5, which is movable on two guide rods 4 of the frame and is driven by a motor 6 through the intermediary of a screw 7, which cooperates with a nut 8 secured to the carriage 5.

The carriage 5 comprises a frame 9, which carries gripping means 10, by which the sheet metal element 1 to be bent can be held in position. In the embodiment shown in FIGS. 1 and 2, the gripping means 10 comprises two lower gripping jaws 11, which are fixed to the frame 9, and an upper gripping jaw 12, which cooperates with both lower gripping jaws 11. The upper gripping jaw 12 is secured to the piston rod of a fluid-operable actuating cylinder 13, which is mounted on the top crosspiece of the frame 9. It is apparent that the gripping means 10 can be actuated to grip the sheet metal element 1 on the carriage 5 in a predetermined plane in a position in which the sheet metal element 1 can be fed by the carriage 5 to the bending machine 2 for the bending operation.

To permit a bending of the sheet metal element 1 at each of its four sides, it must be possible to rotate the sheet metal element about an axis which is normal to said predetermined plane. That rotation is effected by rotary drive means 14, mounted on a bracket 15, which is carried by the frame 3 and protrudes toward the carriage 5. The rotary drive means 14 comprises a motor 16, which through the intermediary of a gear train 17 drives a shaft 18, which carries a rotary gripping jaw 19 adapted to cooperate with a rotary backing jaw integrated in the gripping jaw 12. When the carriage 5 has been retracted to the position indicated in phantom in FIG. 1, the rotary gripping jaw 19 extends between the two lower gripping jaws 11, which are sufficiently spaced apart to receive the rotary gripping jaw therebetween. The rotary gripping jaw 19 can then force the sheet metal element 1 against the rotary backing jaw 12 carried by the carriage 5 so that the sheet metal element 1 can be lifted off lower gripping jaws 11 and rotated by the rotary gripping jaw 19 and the rotary backing jaw 12 cooperating with the rotary gripping jaw 19. The means for lifting the rotary gripping jaw 19 comprises a lifting drive 20 connected to a shaft 18, which is longitudinally slidably mounted in the bracket 15. The lifting drive 20 is fluid-operable and comprises two pistons 21. When fluid pressure is applied to the lifting drive 20, the pistons 21 bear on the frame 9 of the carriage 5 when the latter has been retracted, rather than on the frame 3, so that the carriage 5 then constitutes a feedback path for the gripping forces which are exerted and said forces cannot act on the track for the carriage. When the sheet metal element 1 has been lifted off lower gripping jaws 11 by means of the rotary gripping jaw 19 against the force of the actuating cylinder 13, the sheet metal element 1 cannot be rotated unless the upper gripping jaw 12 comprises a member which is rotatable about the axis of the shaft 18. For this purpose, as shown in FIGS. 7 and 8 a rotary disc 22 is mounted by means of balls 25 held in a plate cage 24 in a carrying member 23, which surrounds the rotary disc 22. As the carrying member 23 is slightly set back from the gripping surface of the rotary disc 22—that set back is so small that it is not shown in the drawing—the workpiece gripped between the rotary gripping jaw 19 and the rotary disc 22 can be freely rotated by means of the shaft 18. The rotary disc 22 is centered by means of a centering pin 26, which extends into a centering bore 27 of the rotary disc 22. The centering pin 26 carries an actuating finger 28, which extends through the centering bore 27 and is smaller in diameter than the bore 27. Because the centering pin 26 is biased by a spring, the centering pin 26 will not extend into the centering bore 27 unless the actuating finger 28 can pass freely through the centering bore 27. As the sheet metal element 1 is moved into engagement with the rotary disc 22, the sheet metal element 1 will first engage the actuating finger 28, which protrudes through the rotary disc toward the sheet metal element 1, so that the centering pin 26 will then be forced out of the centering bore 27 and the rotary disc 22 now has a limited freedom of movement in a plane which is parallel to the undersurface of the rotary disc 22. That freedom of movement corresponds to the difference between the diameters of the centering bore 27 and the actuating finger 28. The displaceability of the rotary disc 22 ensures that its axis of rotation will coincide with the axis of the shaft 18 and that the sheet metal element 1 cannot shift relative to the rotary gripping jaw 19 so that, when the sheet metal element 1 has been rotated it, can be taken over exactly in the desired position by the gripping means 10 carried by the carriage. To permit the sheet metal element 1 to be gripped by the gripping means 10, the lifting drive 20 lowers the rotary gripping jaw 19 so that the actuating cylinder 13 under the action of fluid pressure applied to its forces the sheet metal element 1 against the lower gripping jaws 11. Because the non-rotatable carrying member 23 cooperating with the gripping jaws 11 is set back from the rotary disc 22, the sheet metal element 1 will be elastically deformed so that it will be non-displaceably held on the carriage 5 between the gripping jaws 11 and 12. When the sheet metal element 1 has been bent, the gripping jaw 12 is lifted by means of the actuating cylinder 13 so that the gripping means 10 releases the workpiece. During that operation, the centering pin 26 owing to its spring bias enters the centering bore 27 so that the rotary disc 22 is centered in the carrying member 23.

If it is desired to provide rather heavy gripping means 10, a rotary backing jaw 29 for cooperating with the rotary gripping jaw 19 is desirably mounted on the frame 3, as shown in FIGS. 3 and 4. To ensure in that case that the workpiece portion gripped by the gripping jaws 30 carried by the carriages will be close to the workpiece portion gripped by the rotary gripping and backing jaws 19 and 29, the gripping jaws 30 are formed with recesses 31, which are open toward the rotary gripping jaw 19 and the rotary backing jaw 29, respectively, and are adapted to receive the rotary jaws. A separate fluid-operable actuating cylinder 32 is provided in that case for actuating the rotary backing jaw 29. As the actuation of the carriage is not affected by the weight of the rotary drive means 14, said rotary drive means can be dimensioned as required so that the shaft 18 can be provided with a sufficiently large index disc 33. The same advantage is obviously afforded also by the embodiment shown in FIGS. 1 and 2.

Because the rotary backing jaw 29 for cooperating wih the rotary gripping jaw 19 is not integrated with a non-rotatable gripping jaw of the gripping means 10, the rotary disc 22 may surround the carrying member 23, as is shown in FIGS. 5 and 6. As the rotary gripping means consisting of the gripping jaw 19 and the rotary backing jaw 29 is closed, the actuating finger 28 is forced from the position shown in FIG. 5 to the position shown in FIG. 6 so that the rotary disc is capable of a limited displacement relative to the carrying member 23 in a plane which is parallel to the gripping surfaces of the jaws 19 and 29. That feature produces also the results which have been discussed with reference to FIGS. 7 and 8.

What is claimed is:

1. An apparatus for feeding and rotating a sheet metal element, comprising the combination of (a) a frame, (b) a carriage displaceably mounted on said frame for feeding the sheet metal element, (c) gripping means operable to grip the sheet metal element in a predetermined plane, said gripping means including (1) a non-rotatable gripping jaw mounted on said carriage, (2) a rotary backing jaw mounted on said frame independently of said carriage and rotatable about an axis extending perpendicularly to said plane, and (3) a rotary gripping jaw carried by said frame independently of said carriage, movable perpendicularly to said predetermined plane and rotatable about said axis, said non-rotatable gripping jaw and said rotary gripping jaw being adapted selectively to cooperate with said rotary backing jaw to grip said sheet metal element therebetween, (d) actuating means operable in alternation to force said backing jaw selectively against the non-rotatable gripping jaw or to move the rotary gripping jaw perpendicularly to said predetermined plane against said rotary backing jaw to grip said sheet metal element therebetween, the actuating means comprising (1) a first element connected to said rotary gripping jaw and (2) a second element arranged to engage said carriage when said actuating means is operated while said carriage is in said predetermined position, (3) the first and second elements being movable relative to each other perpendicularly to said predetermined plane, and (e) rotary drive means mounted on said frame independently of said carriage and operable to rotate said rotary gripping jaw when said sheet metal element is gripped between the rotary gripping and backing jaws.

2. The apparatus set forth in claim 1, wherein said actuating means is operable to force said rotary gripping and backing jaws against each other to grip said sheet metal element between them in a second plane which is parallel to and spaced from said predetermined plane and said non-rotatable gripping jaw is arranged to release said sheet metal element as it is moved from said first plane to said second plane.

3. The apparatus set forth in claim 1, wherein said non-rotatable gripping jaw has a recess adapted to receive at least a portion of said rotary gripping jaw in a predetermined position of said carriage.

4. The apparatus set forth in claim 1, wherein said gripping means and said actuating means are operable independently of each other.

5. The apparatus set forth in claim 1, wherein said carriage is movable relative to said frame toward and away from said rotary gripping jaw.

6. The apparatus of claim 5, wherein said gripping means includes a first and second non-rotatable gripping jaw, each of the non-rotatable gripping jaws having a recess adapted to receive at least a portion of said rotary gripping jaw in a respective predetermined position of said carriage.

7. The apparatus set forth in claim 6, wherein said recesses permit a rotation of said rotary gripping and backing jaws when said carriage is in said predetermined position.

8. The apparatus of claim 1, wherein the non-rotatable gripping jaw is adapted to release said sheet metal element when it is gripped between the rotary gripping and backing jaws, and the rotary gripping jaw is adapted to release said sheet metal element when it is gripped between the non-rotatable and backing jaws.

9. The apparatus of claim 1, wherein said gripping means includes two non-rotatable gripping jaws laterally spaced apart, the non-rotatable gripping jaws being disposed to receive at least a portion of said rotary gripping jaw therebetween and to permit rotation of said rotary gripping jaw when said carriage is in a predetermined position, and said rotary gripping and backing jaws are adapted to grip said sheet metal element therebetween when said carriage is in said predetermined position.

10. The apparatus of claim 1, wherein said rotary backing jaw comprises a rotary disc defining a centering bore, and further comprising a carrying member carried by said actuating means and carrying said rotary disc so as to be capable of a limited displacement parallel to said predetermined plane, a centering pin axially slidably mounted in said carrying member, the centering pin protruding and being spring-biased towards said rotary disc and the centering pin having an end portion extending in said centering bore and being smaller in diameter than said centering bore, the centering pin end portion being adapted to protrude from said rotary disc on a side opposite to said carrying member.

11. The apparatus of claim 1, wherein said rotary backing jaw comprises a rotary disc defining a centering bore, and further comprising a carrying member non-rotatably mounted on said carriage and surrounding said rotary disc so as to provide a limited displacement of the rotary disc parallel to said predetermined plane, a centering pin axially slidably mounted in said carrying member, the centering pin protruding and being spring-biased towards said rotary disc and the centering pin having an end portion extending in said centering bore and being smaller in diameter than said centering bore, the centering pin end portion being adapted to protrude from said rotary disc on a side opposite to said carrying member, and the non-rotatable gripping jaw being adapted to force said sheet metal element against said carrying member.

12. An apparatus for feeding and rotating a sheet metal element, comprising the combination of (a) a frame, (b) a carriage displaceably mounted on said frame for feeding the sheet metal element, (c) gripping means operable to grip the sheet metal element in a predetermined plane, said gripping means including (1) a non-rotatable gripping jaw mounted on said carriage, (2) a rotary backing jaw carried by said carriage and rotatable about an axis extending perpendicularly to said plane, and (3) a rotary gripping jaw carried by said frame independently of said carriage, movable perpendicularly to said predetermined plane and rotatable about said axis, said non-rotatable gripping jaw and said rotary gripping jaw being adapted selectively to cooperate with said rotary backing jaw to grip said sheet metal element therebetween, (d) actuating means operable in alternation to force said backing jaw selectively against the non-rotatable gripping jaw or to move the rotary gripping jaw perpendicularly to said predetermined plane against said rotary backing jaw to grip said sheet metal element therebetween, the actuating means comprising (1) a first element connected to said rotary gripping jaw and (2) a second element arranged to engage said carriage when said actuating means is operated while said carriage is in said predetermined position, (3) the first and second elements being movable relative to each other perpendicularly to said predetermined plane, and (e) rotary drive means mounted on said frame independently of said carriage and operable to rotate said rotary gripping jaw when said sheet metal element is gripped between the rotary gripping and backing jaws.

* * * * *